US006475124B1

(12) United States Patent
Weiss

(10) Patent No.: US 6,475,124 B1
(45) **Date of Patent: *Nov. 5, 2002**

(54) ABDOMINAL EXERCISE DEVICE

(75) Inventor: Gene J. Weiss, 856 Stonegate Dr., Highland Park, IL (US) 60035

(73) Assignee: Gene J. Weiss, Highland Park, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/895,527

(22) Filed: Jul. 17, 1997

Related U.S. Application Data

(63) Continuation of application No. 08/653,812, filed on May 28, 1996, now abandoned, which is a continuation of application No. 08/343,117, filed on Nov. 22, 1994, now abandoned.

(51) Int. Cl.[7] ..... A63B 21/008; A63B 23/02

(52) U.S. Cl. ..... 482/113; 482/139; 482/148; 601/6; 601/8; 601/23

(58) Field of Search ..... 601/6, 7, 8, 11, 601/44, 23; 606/121, 123; 482/13, 44, 79, 91, 112, 113, 140, 139, 148, 111

(56) References Cited

U.S. PATENT DOCUMENTS

| | | | | | |
|---|---|---|---|---|---|
| 594,961 | A | | 12/1897 | McLean et al. | |
| 1,861,924 | A | | 6/1932 | Karlstrom et al. | |
| 2,490,395 | A | * | 12/1949 | Wilm | 601/44 |
| 2,623,230 | A | | 12/1952 | Feinen | |
| 2,772,673 | A | * | 12/1956 | Huxley, III | 601/44 |
| 2,927,577 | A | | 3/1960 | Nicolaie | |
| 3,836,141 | A | * | 9/1974 | Franklyn | 482/112 |
| 3,988,793 | A | * | 11/1976 | Abitbol | 601/11 |
| 4,635,618 | A | | 1/1987 | Munz | |
| 4,824,105 | A | | 4/1989 | Goldenberg | |
| 4,832,335 | A | * | 5/1989 | Tong | 482/112 |
| 5,228,431 | A | * | 7/1993 | Giaretto | 601/11 |
| 5,243,968 | A | * | 9/1993 | Byun | 601/11 |
| 5,356,361 | A | * | 10/1994 | Waterpaugh | 482/111 |

FOREIGN PATENT DOCUMENTS

| | | | | |
|---|---|---|---|---|
| AU | 216844 | * | 7/1957 | 601/11 |
| DE | 4228406 | * | 1/1994 | 601/6 |
| FR | 953263 | * | 12/1949 | 601/6 |
| GB | 1417989 | * | 12/1975 | 601/6 |
| SU | 1556676 | * | 4/1990 | 601/6 |
| SU | 1690753 | * | 11/1991 | 601/6 |

* cited by examiner

*Primary Examiner*—Jerome W. Donnelly
*Assistant Examiner*—Victor K. Hwang
(74) *Attorney, Agent, or Firm*—Welsh & Katz, Ltd.

(57) ABSTRACT

The invention performing abdominal exercises includes a rigid shell having a rear portion and a sidewall rigidly attached to the rear portion and extending forward from the rear portion to define an inner chamber. The sidewall forms a rim defining an opening adapted for sealably attaching to the abdominal portion of the body. A vacuum mechanism in fluid communication with the chamber creates suction within the shell such that to contract the abdominal muscles the applied suction must be counteracted by the abdominal muscles. Contracting the muscles against the suction produced by the vacuum exercises the abdominal muscles.

3 Claims, 2 Drawing Sheets

ABDOMINAL EXERCISE DEVICE

This is a continuation of application Ser. No. 08/653,812, filed May 28, 1996, now abandoned, which is a continuation of application Ser. No. 08/343,117, filed Nov. 22, 1994, now abandoned.

BACKGROUND OF THE INVENTION

This invention relates to an exercise device generally, and more particularly to a device for use in exercising the abdominal muscles through application of suction.

Therapeutic medicine has clearly established the fact that muscles can retain their strength and elasticity only if they are forced to perform the balanced movements of both contracting and stretching. Known prior art exercise devices, however, are directed to and are limited to repetitive contraction of abdominal muscles only. Known exercise devices are either designed for the development of mighty abdominal muscles or for superficially toning them by periodic contraction of these muscles against resistance, or by impact produced by various impact devices. Abdominal exercisers typically require use of other muscles in addition to abdominal muscles such as back and leg muscles. In such machines, the user typically bends the back to contract the abdominal muscles or brings the legs forward to accomplish the same purpose. Those with back ailments or other similar problems are unable to use such devices. Additionally, those using such devices may injure other muscles.

In addition, it is desirable that exercise devices be adaptable so that other parts of the body may be exercised. Such an adaptable device saves space which may be at a premium in gyms and homes.

SUMMARY OF THE INVENTION

The disadvantages and problems of the above-described devices for exercising the abdominal muscles are substantially overcome by the present invention by providing an abdominal exerciser that uses suction to exercise the abdominal muscles. Accordingly, it is an object of the present invention to provide an improved device for exercising the abdominal muscles that substantially overcomes the above problems.

It is another object of the present invention to provide an improved exercise device that does not require substantial use of the back or leg muscles when performing the abdominal exercises.

It is yet another object of the present invention to provide an improved exercise device using suction against which the abdominal muscles work.

It is a still further object of the present invention to provide an improved exercise device that can vary the suction to adjust the intensity of the exercise performed.

It is a further object of the present invention to provide an improved exercise device which may be easily adapted to exercise different parts or members of the body.

The invention for performing abdominal exercises includes a rigid shell having an upper portion, sidewalls rigidly attached to the upper portion, the rigid shell defining an internal chamber, and an opening of the chamber disposed opposite the upper portion. The sidewalls form a rim portion disposed along a portion of the opening and is adapted for sealably attaching to the abdominal portion of the body. A vacuum mechanism connected to the shell portion and in communication with the chamber creates suction within the shell such that the applied suction may be counteracted by the abdominal muscles to exercise the muscles.

DESCRIPTION OF THE PREFERRED EMBODIMENT

Figure 1:
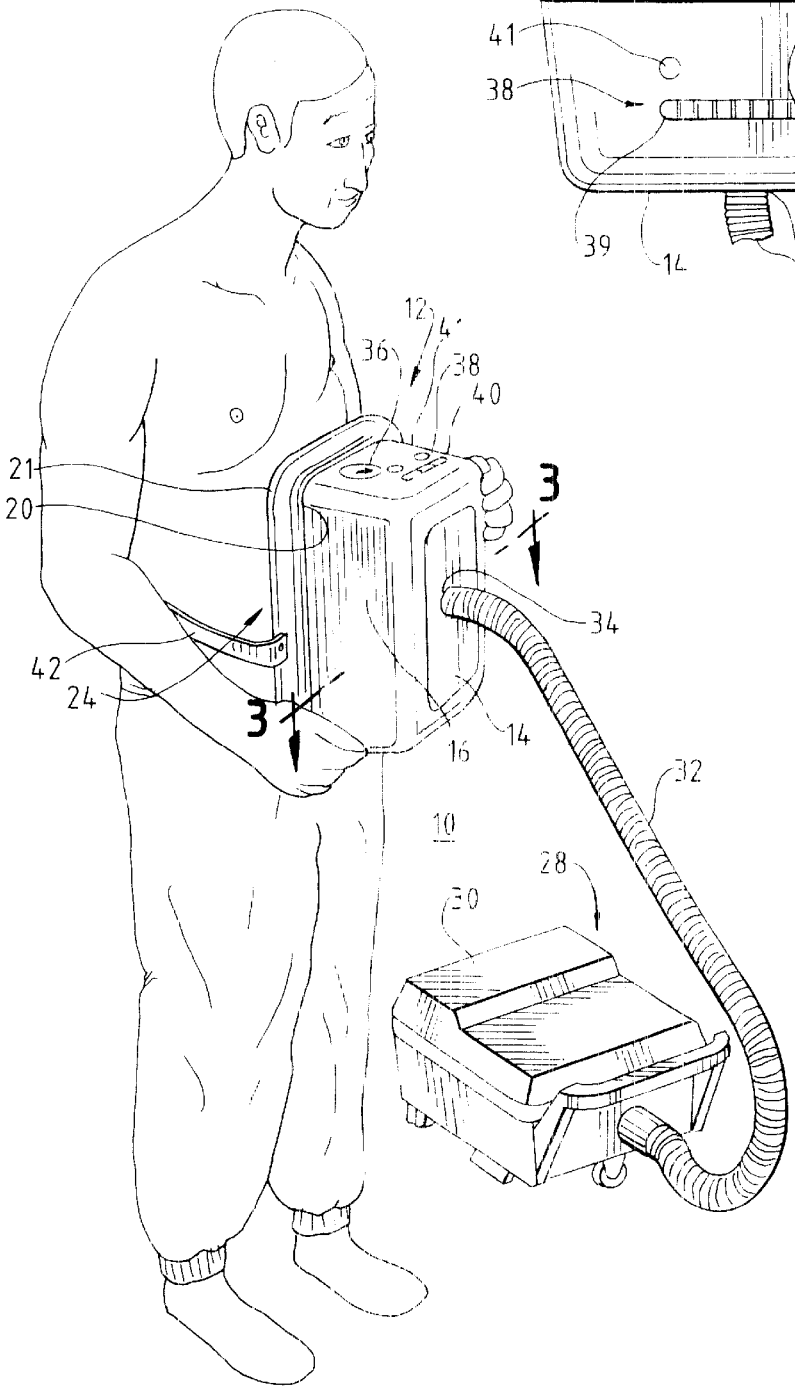
FIG. 1 is a perspective view depicting a user in operational contact with a preferred embodiment of an exercise device.
Figure 2:
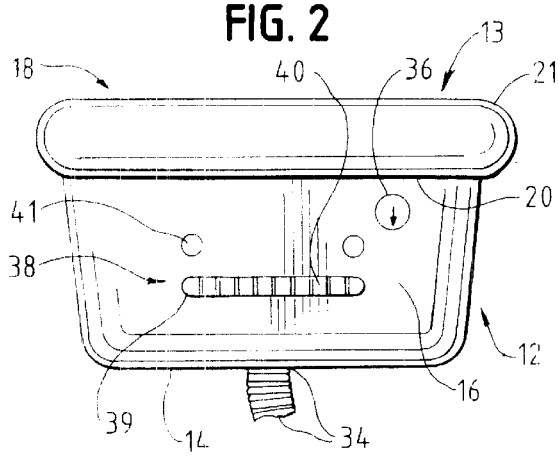
FIG. 2 is a side perspective view of the device shown in FIG. 1.

Referring now to FIGS. 1 and 2, a preferred embodiment of the exercise device is shown generally as 10. The exercise device 10 includes a substantially rigid shell 12 which defines an inner chamber 13. The rigid shell 12 has a rear wall or portion 14 and a side wall 16 rigidly attached about the periphery of the rear portion and extending forward from the rear portion to define an open end 18. The sidewall 16 is preferably integrally formed with the rear portion 14. The forward end of the sidewall forms a rim 20 which may have sealing or cushioning material 21 such as rubber or plastic secured to it so that when the shell 12 is placed on an abdominal portion of a user, the flow of air between the rim 20 and the abdominal portion 24 of the user is restrained. Preferably a substantially air-tight seal should be formed between the rim 20 and the abdominal portion 24. Any suitable sealing material may be used, such as closed cell sponge rubber.

While the shell 12 is depicted as generally rectangular in shape with a rectangular planar rear portion 14, it will be appreciated that any suitable shape or size may be used without departing from the spirit and scope of the invention. Such suitable shapes include a cylinder, a hemisphere, or any irregular shape that provides a rim which sealably contacts at least a portion of the abdominal area of the body such that a sealed chamber 13 is placed about the area.

A vacuum mechanism, shown generally as 28, creates a partial vacuum within the shell 12, and thus, creates suction that "pulls" against the abdominal muscles 24. The vacuum created when the user activates the vacuum mechanism 28 essentially urges the abdominal muscles 24 to distend into the shell 12 such that to contract the abdominal muscles the user must counteract the suction force of the vacuum. Repeated contractions of the abdominal muscle 24 against the force created by the suction effectively exercises the abdominal muscles.

The shell 12 is suitably dimensioned to fit the abdominal portion of the user and may be produced in several sizes to accommodate children and adults. The shell preferably fits over the abdominal portion of the user and may be large enough to extend from just below the breast bone to just above the pelvic bone. Corresponding, the shell 12 is small enough so that the rim 20 sealably contacts the various body contours of the user to attain a vacuum seal.

The vacuum mechanism 28 includes a vacuum pump 30, a vacuum tube 32 connected to the vacuum pump, and a valve 34 or collar located in the rear portion 14 of the shell 12 for connecting the vacuum tube to the shell 12. The vacuum pump 30 and vacuum tube 32 may be supplied by a household vacuum cleaner apparatus whereby the vacuum cleaner hose easily attaches to the valve 34 or collar located in the shell 12. Once the vacuum cleaner is activated, the vacuum is supplied, and hence, suction is created within the chamber 13. Alternatively, the vacuum pump 30 may be a stand-alone pump powered by household electricity or may be a battery powered pump. The vacuum pump 30 may also be a hand powered pump such as a squeeze-bulb pump (100,FIG. 4 ) which produces a vacuum when repeatedly squeezed. Any suitable device for creating a vacuum may be used. Such vacuum producing pumps and equipment are common, inexpensive, and well known in the art.

The exercise 10 device may also include a vacuum gauge 36 attached to the shell 12. The vacuum gauge 36 measures the vacuum created to indicate to the user the current level of exertion, since the greater the vacuum, the greater the suction force exerted on the abdominal muscles 24, and hence, the greater the intensity of the exercise in the contracting of the muscles.

A vacuum adjustment mechanism 38 may be disposed in the shell 12 to allow the user to vary the applied vacuum. The vacuum adjustment mechanism 38 allows a controlled amount of air flow into the shell so that the amount of suction may be reduced or increased by the user. The vacuum adjustment mechanism 38 includes a slot 39 preferably disposed in the sidewall 16 of the shell and a movable sliding door 40 capable of selectively blocking the slot when moved by the user. This allows the user to easily adjust suction force and thus the level of exercise. For example, if the user decides to reduce the exertion level of the exercise, the door 40 may be moved towards an open position so that the vacuum is significantly reduced. When the user wishes to increase the exertion level, the door 40 is shut to allow the vacuum to increase to appropriate exercise levels. Alternatively, the vacuum adjustment mechanism 38 may be, for example, a valve with a controllable opening, a rotatable vent, or any suitable mechanism which controls the level of vacuum within the shell 12. The vacuum pump 30 may also include a control which varies the level of vacuum such as a port in the hose which may be selectively opened. Of course, placement of the vacuum gauge 36 or the vacuum adjustment mechanism 38 is not limited to any specific location on the shell 12 and may be placed at any convenient location.

The shell may also include two finger holes 41 adjacent the slot 39 in the sidewall 16. When the exercise device 10 is activated, it is preferred that the user block each finger hole 41 with a finger to maintain the vacuum. This allows for an effective emergency reduction of the suction by removal of the fingers from the finger holes 41, should such a reduction be necessary.

In an alternate embodiment, a single vacuum mechanism 28 may provide the vacuum to a plurality of exercise shells 12 through a series of vacuum tubes. The plurality of shells 12 could then be used by a number of users at the same time. This is economical since only a single vacuum pump 30 is needed.

In another embodiment, a belt or strap 42 may be provided to secure the shell 12 to the user. The belt 42 may attach to the shell 12 and encircle the user's waist to further secure the shell when the user is in the vertical position. For example, such a belt 42 may fasten with VELCRO®, or may be in the form of a seat belt with clasps.

Figure 3:
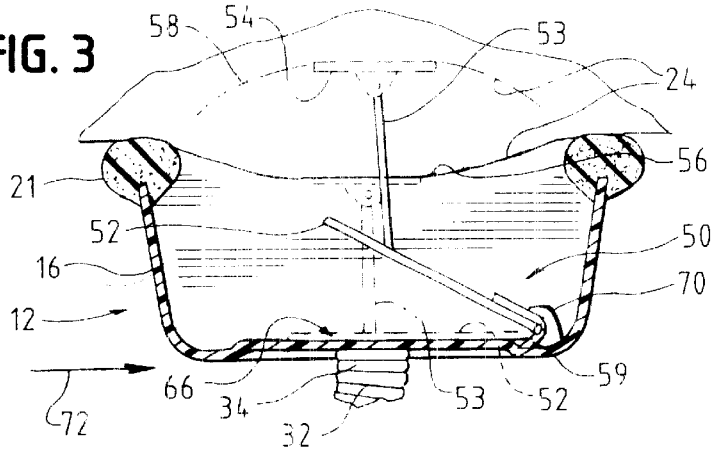
FIG. 3 is a cut-away side view of the shell depicting a plunger mechanism according to a specific embodiment of the present invention taken along line 3—3 of FIG. 1.

Referring now to FIG. 3, an alternate embodiment of the exercise device 10 of FIG. 1 is shown having a plunger mechanism, shown generally as 50. Various exercise devices attempt to maintain a constant amount of tension or force exerted by the muscles throughout the entire range of muscle movement. The plunger mechanism 50 responds to the amount of the displacement of the abdominal muscles 24 and varies the vacuum level so as to vary the force of the suction dependent on the configuration of the abdomen.

The plunger mechanism 50 includes a flap 52 having one end mounted to the rear portion 14 of the shell 12. The other end of the flap 52 is pivotally attached to an arm 53. The other end of the arm 53 connects to a foot 54 adapted to contact the abdominal muscle area 24. When the abdominal muscles are most relaxed (most distended) as shown by numeral 56, the arm 53 is in a first position, shown as I. When the abdominal muscles 24 are least relaxed or most contracted, as shown by a dashed line and designated as numeral 58, the arm 53 is in a second position, shown as II. A spring 59 disposed at the end of the flap 52 mounted to the shell 12 urges the flap 52 and the arm 53, and hence, the foot 54, against the abdominal portion 24 of the user regardless of the position of the user. Thus, the user may be vertical or horizontal when using the exerciser 10.

The position of arm 53 relative to the abdominal muscles 24 and the shell 12 communicates the effective position of the abdomen to the flap 52. Depending upon the position of the arm 53, the flap 52 partially blocks the opening 66 of the vacuum tube 32 at a point where the tube enters the shell 12. This varies the level of applied vacuum. When the abdominal muscles 24 are most relaxed, as shown by numeral 56, the vacuum is maintained at a minimum level since the flap 52 is in the most closed position covering the opening 66. Conversely, when the abdominal muscles 24 are most contracted, as when the user is exercising heavily, as shown by numeral 58, the vacuum is maintained at a maximum level since the flap 52 is in the most open position allowing full suction to be applied.

Alternatively, the minimum and maximum vacuum levels may be adjusted by the user to provide a comfortable exercise level. For example, the minimum vacuum level may be increased while the maximum vacuum level may be decreased by adjusting the plunger mechanism.

The spring 59 also biases the flap 52 away from the opening 66 to counteract the suction force applied by the vacuum pump 30. The angular displacement of the flap 52 governed by the arm 53 and abdomen 24 when the abdomen is relaxed, forces the flap 52 to at least partially block the opening 66 by overcoming the biasing force of the spring 59.

The flap 52 need not be attached to the arm 53 such that displacement of the arm results in an equal displacement of the flap. Rather, the plunger mechanism 50 may include a mechanism, such as a gear and ratchet mechanism 70 which translates movement of the arm 53 into an incremental movement of the flap 52. For example, displacement of the arm 53 may not cause angular displacement of the flap 52, but rather, may cause horizontal displacement of the flap in a direction parallel to the upper portion 14 of the shell, as shown by the arrow labeled 72. Thus, displacement of the arm 53 may cause the flap 52 to be horizontally displaced relative to the opening 66 so that a small portion of the opening is partially blocked. This allows displacement of the arm 53 to accurately control coverage of the flap 52 over the opening 66 to maintain a desired level of vacuum within the chamber 13. Thus, the plunger mechanism 50 adjusts the vacuum level to keep a substantially constant force against the abdominal muscles 24 so that the user experiences a substantially "constant resistance" when exercising.

Alternatively, the size and shape of the shell 12 may be altered to provide an exercise device for muscle groups other than the abdominal muscle.

Figure 4:
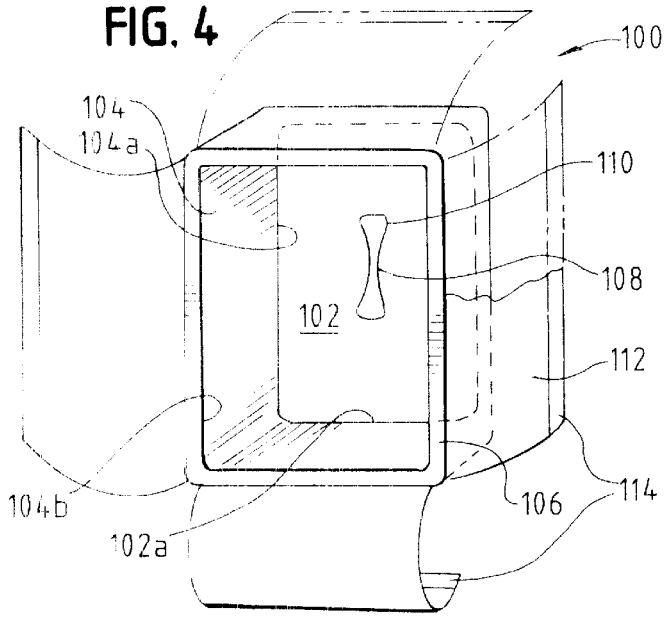
FIG. 4 is a front perspective view of a preferred embodiment of an attachment to the exercise device of FIG. 1.
Figure 5:
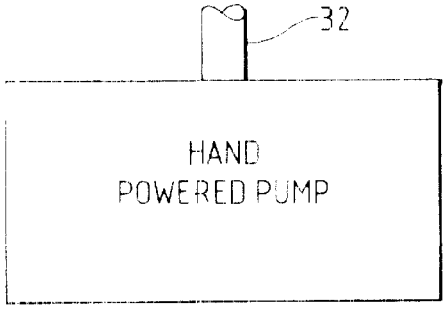
FIG. 5 is a block diagram of a hand powered pump that may be used with the system of FIG. 1.

Referring to FIG. 4, in conjunction with FIG. 1, an apparatus for use in combination with the exercise device 10 to form an assembly for exercising such members of the body as the arms and legs is shown generally at 100. The apparatus 100 is configured to utilized the suction created within the shell 12 to provide a force resisting the outward movement of a planar member 102 within the chamber 13. The member 102 is preferably rigid and maybe made of any suitable material. The member 102 is attached about its periphery to an inner end 104*a* of a diaphragm 104 composed of a flexible material which is substantially nonporous to the passage of air, such as a rubberized cloth.

The planar member 102 is sized so that it fits between the sidewalls 16 of the shell 12 in a position which is substantially parallel to the rear portion 14 and may freely move within the shell toward and away from the rear portion. An outer end 104*b* of the diaphragm is attached to a liner 106 which is preferably elastic, and sized so that the liner may be stretched about and sealingly engaged to the sealing material 21 about the rim 20 of the shell 12. Because of the elasticity, the liner 106 may be slightly stretched to fit about and sealingly engage the rim 20.

As will be noted, when the assembly 100 is attached to the shell 12, the planar member 102, diaphragm 104 and liner 106 combine to seal against, or severely restrict the flow of air, so that the suction force created by the vacuum pump 30 draws the planar member 102 back toward the rear portion 14. The suction force also provides a force of resistance opposing the movement of the member 102 away from the rear portion 14 and toward the rim 20. A grasping member 108 for applying an outward directed force to move the planar member 102 away from the rear portion 14 is attached to the planar member 102. The grasping member 108 is preferably a handle 110 but may also be an adjustable strap with a hood and pile arrangement so that a foot or hand may be removably attached to the planar member 102.

To fixably attach the assembly 100 to the shell 12 so that use of the assembly does not dislodge the assembly from the shell, the assembly includes a number of self-attaching flaps 112. The flaps 112 have sufficient length to extend around the sidewall 16 to the exterior of the rear portion 14 where the flaps may be attached to each other by means of hook and pile strips 114 which are placed on both sides of each of the flaps in close proximity to the outer end 112*a* of the flaps.

In operation, the user takes the insert apparatus 100 and inserts the planar member 102 into the chamber 13 and positions the member 102 so that it is generally co-planar with the rear portion 14 of the shell 12. The liner 106 is then juxtaposingly extended about the sealing material 21 disposed about the rim 20. With this placement, the diaphragm 104 extends generally along the sidewall 16 within the chamber 13. The flaps 112 are then folded along the exterior of the sidewall 16, around the rear portion 14 and attached to each other with the hook and pile strips 114. The flaps 112 should be attached so that they are taut along the shell 12 to firmly anchor the liner 106 along the rim 20.

The vacuum pump 30 is then activated which creates a suction in the space defined by and between the apparatus 100 and shell 12 within the chamber 13. The suction draws the member 102 against or in close proximity to the rear portion 14. The user may then grasp the grasping member 108 to pull the planar member forward, away from the rear portion 14 and toward the rim 20. After the user has pulled the planar member 102 away from the rear portion 14 and preferably to a position generally aligned with the rim 20, the user may than reduce the pulling force so that the suction pulls the member 102 back toward the upper portion 14. This process may than be repeated until the exercise activity is complete.

Specific embodiments of the abdominal exercise device according to the invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic principles disclosed and claimed herein.

What is claimed is:

1. An exercise apparatus for developing a set of abdominal muscles of a human body, such apparatus comprising:

means for distending the set of abdominal muscles by application of a vacuum to such muscles, said means providing a progressive resistance to a contraction of the distended abdominal muscles against the vacuum; and a sealing means for maintaining vacuum against the body.

2. The apparatus as in claim 1 further comprising a flap which controls the vacuum depending upon the distension of the set of abdominal muscles.

3. The apparatus as in claim 1 further comprising a vacuum source.

* * * * *